US005538080A

United States Patent [19]

Bassinger

[11] Patent Number: 5,538,080

[45] Date of Patent: Jul. 23, 1996

[54] SELF ALIGNING STUFFING BOX FOR PUMPJACK UNITS

[76] Inventor: Grey Bassinger, c/o Max Design, 1308 S. Midkiff, Suite 125, Midland, Tex. 79701

[21] Appl. No.: 300,282

[22] Filed: Sep. 2, 1994

Related U.S. Application Data

[63] Continuation-in-part of Ser. No. 942,897, Sep. 10, 1992, Pat. No. 5,343,944.

[51] Int. Cl.[6] ..... E21B 33/03

[52] U.S. Cl. ..... 166/84.2; 277/30

[58] Field of Search ..... 166/84, 72, 170, 166/176; 251/1.1, 1.2; 277/2, 15, 30; 417/390

[56] References Cited

U.S. PATENT DOCUMENTS

| | | | |
|---|---|---|---|
| 1,128,793 | 2/1915 | Kobbe . | |
| 1,911,670 | 5/1933 | Black | 277/30 |
| 1,947,198 | 2/1934 | Goble | 277/17 |
| 2,002,012 | 5/1935 | Howard . | |
| 2,069,443 | 2/1937 | Hall | 166/84 X |
| 2,159,306 | 5/1939 | Winters | 277/30 |
| 2,179,814 | 11/1939 | Conagham | 166/84 X |
| 2,674,474 | 4/1954 | Lister . | |
| 2,721,748 | 10/1955 | Tremolada | 277/30 |
| 3,468,374 | 9/1969 | Reeves . | |
| 3,512,787 | 5/1970 | Kennedy et al. | 277/4 |
| 3,887,196 | 6/1975 | Renfrow | 277/2 |
| 3,939,910 | 2/1976 | Bruce | 166/84 |
| 4,099,562 | 7/1978 | Mattoon | 166/84 |
| 4,345,766 | 8/1982 | Turanyi | 277/30 |
| 4,530,397 | 7/1985 | Calhoun | 166/84 |
| 4,647,050 | 3/1987 | Johnson | 277/19 |
| 4,889,184 | 12/1989 | Lugtmeier et al. | 166/84 X |
| 4,896,367 | 1/1990 | Newton et al. | 384/16 |
| 4,981,174 | 1/1991 | White | 166/84 |
| 5,058,668 | 10/1991 | Newton | 166/84 |
| 5,137,083 | 8/1992 | Bump | 166/84 |
| 5,217,068 | 6/1993 | Newton | 166/84 |

*Primary Examiner*—Frank S. Tsay
*Attorney, Agent, or Firm*—Marcus L. Bates

[57] ABSTRACT

A self aligning stuffing box for a pumpjack unit of the type having a polished rod reciprocatingly extending therethrough and downhole to a pump located at the lower end of a borehole. The stuffing box has a main body that terminates in a tubing adaptor at the lower end thereof by which it can be mounted to the upper end of a wellhead. The main body forms an upward opening chamber within which an annular seal assembly for sealingly engaging the polished rod is received. The polished rod reciprocatingly extends through the seal assembly and main body. The seal assembly and chamber together form a lubrication chamber that extends outwardly about the seal assembly. The seal assembly moves within the chamber radially of the passageway to align the polished rod with the production tubing of the wellhead. The adaptor forms a pack-off that isolates the seal from the wellbore, and provision is made by which the seal assembly can be replaced without removing the polished rod from the pumpjack unit.

20 Claims, 6 Drawing Sheets

SELF ALIGNING STUFFING BOX FOR PUMPJACK UNITS

BACKGROUND OF THE INVENTION

This patent application is a Continuation-In-Part of patent application Ser. No. 07/942,897 filed Sep. 10, 1992 now U.S. Pat. No. 5,343,944, issued Sep. 6, 1994 to which reference is made for further background of this invention. The present invention provides a stuffing box having the self aligning features found in my previous patent, and further includes the improved design of a dual seal pack as well as the improvement in the lubrication system which adds unexpected long life to the seals thereof as well as affording a unique means of seal adjustment heretofore unknown to those skilled in the art.

In my previous patent, when pressure set seals are employed, as the rod is reciprocated within the stuffing box, ambient pressure is effected against the uppermost seal of the pack while the lube oil chamber pressure is effected against the lowermost seal thereof. Where pressure set seals are employed, the lips of the seals are always set such that the lube oil is wiped from the rod surface on the upstroke with the residual lube oil providing the proper desired amount of lubricant on the downstroke, and this action results in elongated seal life.

Where dual seal packs are employed, it has been found that the bottom seal pack almost always is the first of the pair of seal packs to fail. Upon failure of the bottom seal pack, produced oil communicates with the upper seal pack as well as the lube chamber, all of which results in a shortened life of the upper seal pack, which up until now had a long life expectancy due to the protection afforded by the operative lower seal pack.

Hydraulically set seals, also referred to as pressure set seals, are quite different from compression set seals, namely the former are not adjusted and therefore changing the seal chamber depth does not improve its seal characteristics, while changing the seal chamber depth of the latter greatly improves its seal characteristics.

Consequently, by the present invention, it has been found advantageous to employ dual seal packs wherein an upper seal is pressure set while the lower seal is compression set. Accordingly, as the lower compression set seal pack wears, it is desirable to be able to periodically adjust the worn lower seal pack without having to disturb or adjust the upper hydraulic set seal pack, which until now has been captured in an optimunly adjusted manner.

Further, it has been found advantageous to use a pressure set seal pack for the upper seal means and a compressive seal pack for the lower seal means for several heretofore unappreciated reasons.

In the embodiments of this invention, when a pressure set lower seal pack is employed, lube oil skids or hydroplanes past the lip of the seal and thereby is pumped from the lube chamber into the annulus, and accordingly, the lube oil is thereby rapidly depleted. Should this condition go unnoticed, it can result in early failure of the lower seal pack. Further, in a stuffing box of a design where only half the lube oil in the lube oil chamber is available to the seals, failure is more likely to occur sooner due to this unfavorable condition going undetected in time to save the seal integrity. In any event, the use of pressure set seals at both the upper and lower locations in a seal structure or assembly is sometime found to be less desirable as compared to the other described seal structures of this invention.

Therefore, many unforeseen advantages are realized when a pressure set upper seal pack is employed in conjunction with a compressive lower seal pack in accordance with the present invention. In this instance the lube oil will not skid or hydroplane across the sealed interface between the rod or shaft and the seal, because the oil is wiped from the rod surface by the compressive force of the seal on both the upstroke and downstroke, and as long as the proper compressive forces are effected across the faces of the lower seal pack, the lubricant contained within the lube chamber will be slowly rather than rapidly depleted, the lower seal will enjoy an unusually long life, and the upper seal pack will always be available to prevent contamination of the environment for a limited time after the lower seal pack fails. Such a desirable improvement is the subject of this invention.

SUMMARY OF THE INVENTION

A self aligning stuffing box has an improved seal assembly contained therewithin that forms a wall of an oil reservoir contained within the box. The oil reservoir surrounds the seal assembly. The stuffing box includes a main body which receives a removable closure member thereon, and further includes a downwardly extending part that is fastened to the upper end of a production string, for example.

The closure member and main body jointly form a chamber within the box. The chamber receives the seal assembly therewithin; and, the main body, closure member, and seal assembly cooperate in sealed relationship respective to one another to form a sealed passageway through the box and seal assembly that receives a shaft, such as a polished rod, in sealed relationship therewith. The seal assembly is arranged for radial movement within the chamber in a manner such that the passageway of the stuffing box can be moved eccentrically in any radial direction within a plane that lays perpendicular to the polished rod to thereby accommodate misalignment between a pumpjack horsehead and the vertical axis of a borehole, for example. The unique seal assembly utilizes commercially available seal components mounted within a seal fixture thereof.

The self aligning features of the stuffing box in combination with the novel oil reservoir elongates the expected life of the seal means associated with the stuffing box and also afford means by which an appropriate relative compressive pressure can be effected individually on the seals thereof; with means being provided by which a lower seal fixture can be moved axially to change the compression on a lower seal pack without changing the compression on an upper seal pack thereof. This unusual feature of the invention allows the incorporation into the seal assembly of a compression set lower seal pack in combination with a pressure set upper seal pack, from which unexpected useful and desirable results are obtained.

As a subcombination of the invention, a wellhead adaptor is mounted below the self aligning stuffing box and connects the lower end of the main housing to the well tubing. The adaptor has a pack-off device included therein that expands into the annulus between the polished rod and the pack-off unit. The pack-off is actuated by rotating the main body of the stuffing box respective to the wellhead adaptor. This action expands the pack-off device into the annulus between the polished rod and the wellhead adaptor, thereby isolating the lower tubing annulus from the seal assembly.

A primary object of this invention is the provision of an improved stuffing box having a seal assembly mounted within a chamber contained within the main body thereof, with there being a pair of seal packs arranged in spaced relationship respective to one another. Each seal pack is supported within a fixture therefor. An oil reservoir is formed within the main body and outwardly of the seal assembly and provides lubricant to the seal packs. Means are provided by which a lower seal fixture can be moved axially to change the compression on the lower seal pack thereof without changing the compression on an upper seal pack thereof.

Another object of this invention is the provision of a stuffing box having an oil reservoir formed within the main body thereof and outwardly of a seal assembly contained therewithin. Passageways connected to the oil reservoir provide a constant supply of lubricant to the seal assembly, which is arranged for radial movement within the chamber in a manner such that the passageway of the stuffing box can be moved eccentrically in any radial direction within a plane that lays perpendicular to the polished rod to thereby accommodate misalignment between a pumpjack horsehead and the vertical axis of a borehole. This novel arrangement elongates the expected life of the seal means and enables the appropriate relative pressure to be effected individually on the seals thereof.

A still further object of this invention is to provide a self aligning stuffing box having a lubrication chamber formed therewithin. A seal assembly provides a rod passageway through the chamber and separates the rod from the oil chamber. The seal assembly has upper and lower seal packs mourned within axially aligned fixtures, with means being provided by which the lower fixture can be moved axially to change the compression on the lower seal pack without changing the compression on the upper seal pack.

Still another object of this invention is to disclose and provide a self aligning stuffing box that can be mounted to receive a moving shaft therein, and having an upper seal mounting fixture within which an upper seal means is captured and a lower seal mounting fixture within which a lower seal means is compressed; and means associated with said upper and said lower seal mounting fixtures by which only the sealed operating condition of the lower seal means is changed by adjustment of either of said upper and lower seal mounting fixtures; whereby, changes can be effected in the sealed operating condition of said lower seal means but not in the sealed operating condition of said upper seal means without disassembly of the stuffing box.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described herein.

DETAILED DESCRIPTION OF THE PREFERRED EMBODIMENT

Figure 1:
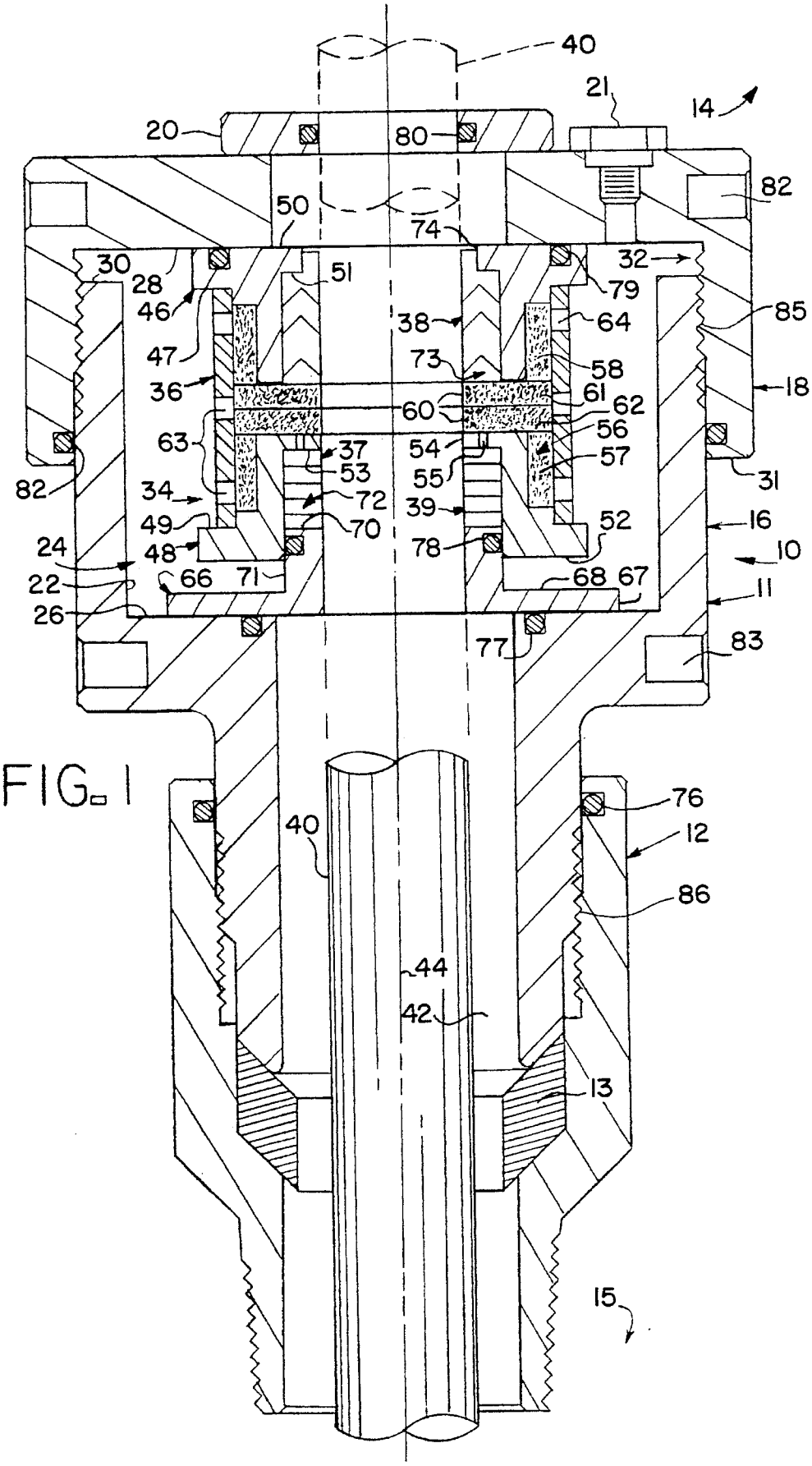
FIG. 1 is a longitudinal, cross-sectional, side view showing a preferred embodiment of a stuffing box and packer apparatus of this invention.

FIG. 1 discloses the combination 10 of a self aligning stuffing box 11 and a wellhead adaptor 12, made in accordance with the present invention. The improved stuffing box 11 is supported by the wellhead adaptor 12. The wellhead adaptor 12 also serves as a pack-off for containing the well fluids when it is desired to work on the stuffing box 11. A resilient pack-off 13 is arranged within the adaptor 12 for reasons that are more fully set forth in my copending patent application.

Throughout the figures of the drawings, wherever it is possible or logical to do so, like or similar numerals will be used to indicate like or similar elements.

In FIG. 1, numeral 14 indicates the location of a pumpjack unit (not shown) which reciprocates a downhole pump 15 (not shown) in the usual manner. The improved stuffing box 11 preferably is of annular configuration and includes an upwardly directed circumferentially extending sidewall 16 that receives a closure member 18 thereon. Stacker ring 20 is freely supported on an upper face of the annular closure member 18. The stacker ring 20 and filler plug 21 are optional details of design that serve to enhance the operation of the apparatus 10.

Within housing 16 there is an inner circumferientially extending wall surface 22 that forms an upwardly opening chamber 24 within which lube oil and a seal assembly is housed. The chamber 24 has a floor 26 opposed to and confronting a top wall surface or roof 28 of the closure member 18, which preferably is sealingly received in an adjustable manner respective to the upper end 30 of the housing 16, preferably leaving operating space 32 between the intervening surfaces 28 and 30.

In FIG. 1, together with other figures of the drawings, the arrow at numeral 34 indicates a seal assembly made in accordance with this invention. The seal assembly 34 has an outer wall surface formed by an annular spacer sleeve 36, and an inner wall surface 37 formed by an upper and a lower seal means, shown herein as upper and lower seal packs 38 and 39. Preferably each of the upper and lower seal packs 38 and 39 include a plurality of seal members therein. A polished rod 40 is adapted to be reciprocatingly received in sealed relationship therewithin. It is noted that the polished rod 40 forms an annulus 42 respective to the main body 16, and that an axial centerline 44 defines the longitudinal axis of the rod 40 and seal assembly 34, which is not necessarily the axial centerline of the main body 11.

Seal assembly 34 includes axially aligned, upper and lower, annular seal mounting fixtures 46 and 48, respectfully, that have the illustrated upper and lower faces 50 and 52 thereof, respectfully, mounted in opposition respective to one another. The mounting fixture 48 has a circumferientially extending shoulder 49 formed thereon that abuttingly engages the lower edge of the sleeve 36, and further includes a face 53 that is formed on an inwardly directed flange 54 thereof and thereby provides a stop against which the lower seal pack 39 to abuttingly engage. Aperture 55 provides means for pushing the lower seal pack 39 out of the lower fixture during disassembly.

The upper and lower seal mounting fixtures 46 and 48 are axially aligned respective to one another and to an annular oil wick chamber 56 within which annular wicks 57, 58 and 60 are mounted. The wafer like wicks 60 are located between the confronting adjacent ends 61, 62 of the upper and lower seal mounting fixtures 46 and 48, where they are held in the illustrated position of FIG. 1. The wicks can take on any number of different forms so long as they translocate lubricant from the lube chamber 24, through the radial ports 63, 64 and onto the interface located between the pair of seal packs and the rod 40 located within the passageway formed through the stuffing box, and thereby assure ample lubrication of the individual seals thereof.

Lower support member 66 has an outwardly directed lower flange 67, the lower face thereof being slidably supported for lateral or radial sealed movement respective to the floor 26 of the housing 16. Upper face 68 of flange 67 is spaced from and biased away from the confronting lower face 52 of lower seal mounting fixture 48 by means of lower seal pack 39, which is shown compressed between confronting faces 53, 70 of members 48, 66. It should be appreciated that annular member 71 of lower support member 66 is reciprocatingly received within cylindrical counterbore 72 of member 48. Hence the upper seal pack 38 is held loosely captured within a fixed depth chamber of the upper fixture 46, while the lower seal pack 39 is held compressed within a variable depth chamber of the lower fixture 48. Those skilled in the art, having fully digested FIG. 1, will soon come to realize that the lower seal chamber can be varied by several expedients, as will be more fully discussed later on in this disclosure.

Numeral 73 illustrates that the lower face of upper seal pack 38 is spaced from the upper face of wick 60. The upper seal fixture 46 is prevented from upward movement by the roof 48 while the lower seal fixture 48 is prevented from upward movement by the presence of annular spacer 36. Further, the lower seal fixture 48 is resiliently biased in an upward direction by the compressive forces exerted on the opposed faces of the lower seal pack 39. Thus the upper seal pack 38 is loosely captured in the constant depth seal chamber and between members 51 and 60, with the wick 60 loosely filling part of the intervening space as shown that is; the bottom of the seal pack 38 normally is displaced in an upward direction by pressure differential thereacross and therefore does not necessarily contact the wick 60. Numeral 74 illustrates the manner in which the uppermost seal member of the upper seal pack 38 provides a resilient guide means so that the rod 40 does not directly contact the metallic parts of the upper fixture 46.

O-ring grooves 76, 77, 78, 79 and 80 have the illustrated O-rings received therein and thereby prevent leakage of lubricant and well fluid thereacross.

The pair of seal assemblies 37 preferably is comprised of a plurality of commercially available split pressure seals at upper seal pack 38, and a plurality of split compression seals at lower seal pack 39.

One example of suitable seals that can be used in the pressure set upper seal pack is a three piece pack of split seals, part number JW 830-24, available from James Walker & Co. Ltd. This seal is not intended to be compressed and is designed to be used in a fixed depth housing such as shown at 73 in FIG. 1.

One example of suitable seals that can be used in the compression set lower seal pack is a multi-piece pack made of preformed, or rope type packing, part number PE 1000, available from Palmetto Inc., which has the following dimensions: 1.5 inches×2.25 inches×⅜ inches. This seal is intended to be compressed and is therefore designed to be used in a variable depth housing such as shown at 72 in FIG. 1.

Figure 2:
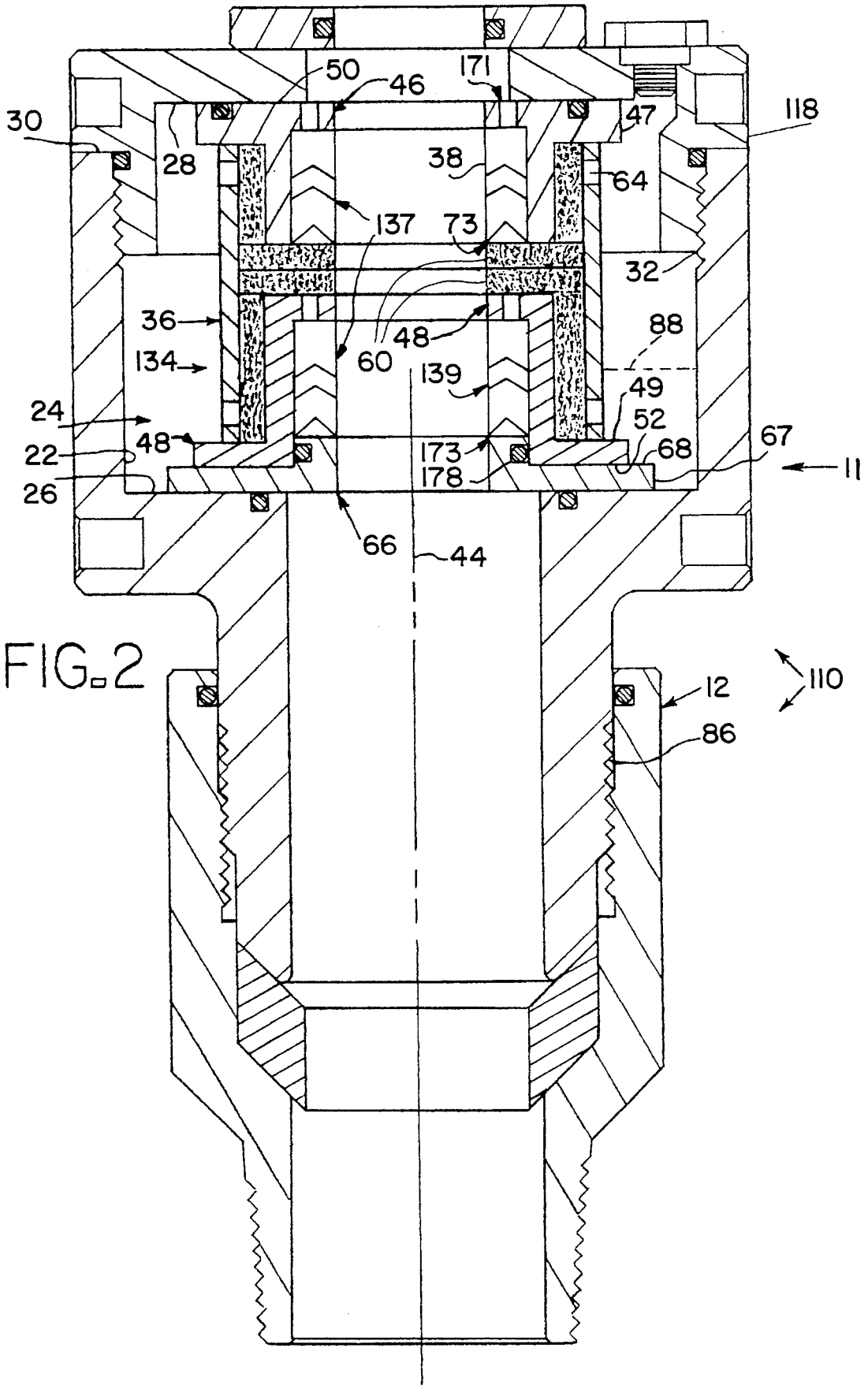
FIG. 2 is a longitudinal, cross-sectional, side view that sets forth the second embodiment of a stuffing box and packer apparatus of this invention.

In the embodiments of the invention seen in the figures of the drawings, and in particular FIG. 2, an annular resilient member (not shown), such as an annular wave spring, or a stack of Bellville washers, can be interposed between faces 68, 52 of members 48, 66, whereby the member 48 is continually urged away from member 66. Accordingly, moving the closure member 18 toward the floor 26 (tightening the cap 18), forces face 52 axially towards face 68. This action telescopes member 71 further into member 48, thereby compressing the lower seal pack 39 which changes the compressive force applied thereto, thereby changing the sealed condition thereof. At the same time, it should be noted that the upper seal pack 38 is not changed during this adjustment, due to the presence of the spacer 36. Accordingly, the embodiment 10 of FIG. 1 and 110 of FIG. 2 has plural, axially spaced, axially aligned, upper and lower seal means 38, 39 individually captured within fixtures 46, 48 in a manner whereby axial movement of the lower fixture 48 does change the compression on the lower seal means 39 but does not change the compression on the upper seal 38, so that the sealed operating condition or sealed relationship thereof remains unchanged.

In the figures of the drawings, and in particular FIG. 1, threaded coacting surfaces at 85 allow the closure member 18 to force members 46, 66 towards one another, thereby changing the compressive forces effected within the seal assembly. Threaded coacting surfaces 86 allow the coacting members 11 and 12 to move towards one another, for changing the compressive forces exerted on the packer device 13.

FIG. 2 of the drawings disclose a seal assembly 137 within which there is received upper and lower pressure set seal packs, 38 and 139, respectively, each being suitably arranged within a fixed depth seal cavity of the upper and lower seal mounting fixtures 46, 48, respectively. The opposed faces of flanges 47 and 67 sealingly engage the chamber roof and floor 26 and 28 in the before described manner of FIG. 1, with the seal fixtures thereof being fixed against axial movement respective to one another, as shown.

The outwardly extending flanges 47 and 49 of the upper and lower seal mounting fixtures 46, 48 receives the opposed ends of spacer 36 to thereby properly space out the members for sealed, sliding engagement respective to the roof and floor of the chamber. The liquid level 88 indicates the lube oil supply. The seals packs 38, 139 are both illustrated as pressure set seals.

Figure 3:
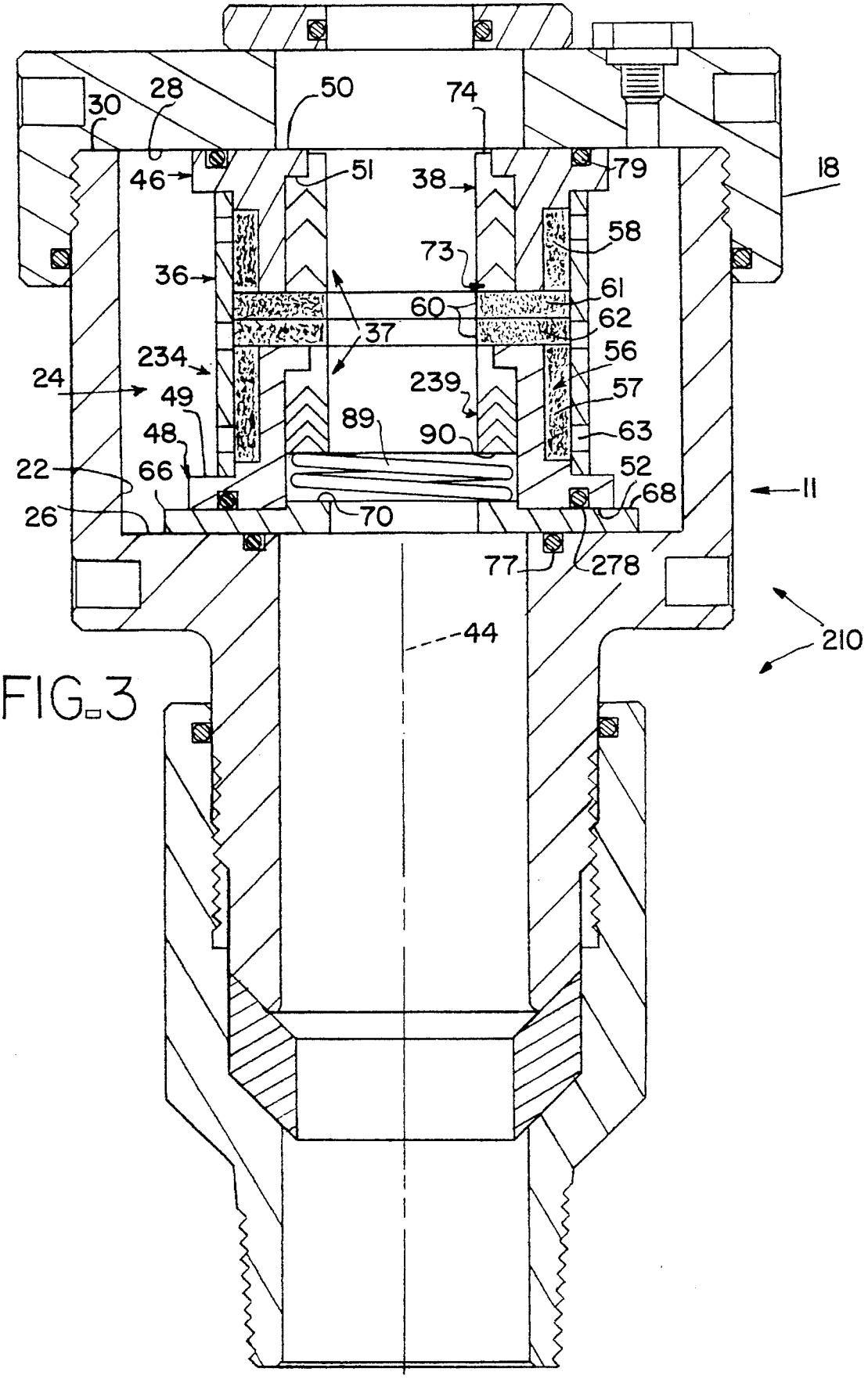
FIG. 3 is a longitudinal, cross-sectional, side view presenting the third embodiment of a stuffing box according to this invention.

FIG. 3 is similar to FIG. 2, and additionally includes a resilient member in the form of spring 89 interposed between lower end 90 of lower seal pack 239 and face 70 of the lower support member 66. O-ring groove 278 seals the interface between the confronting flanges 52, 68 of the adjacent members 48 and 66. This arrangement of the seal assembly 234 maintains a constant upward force on the lower seal pack 239 that is equal to the spring force together with the hydraulic force effected at 90.

Figure 4:
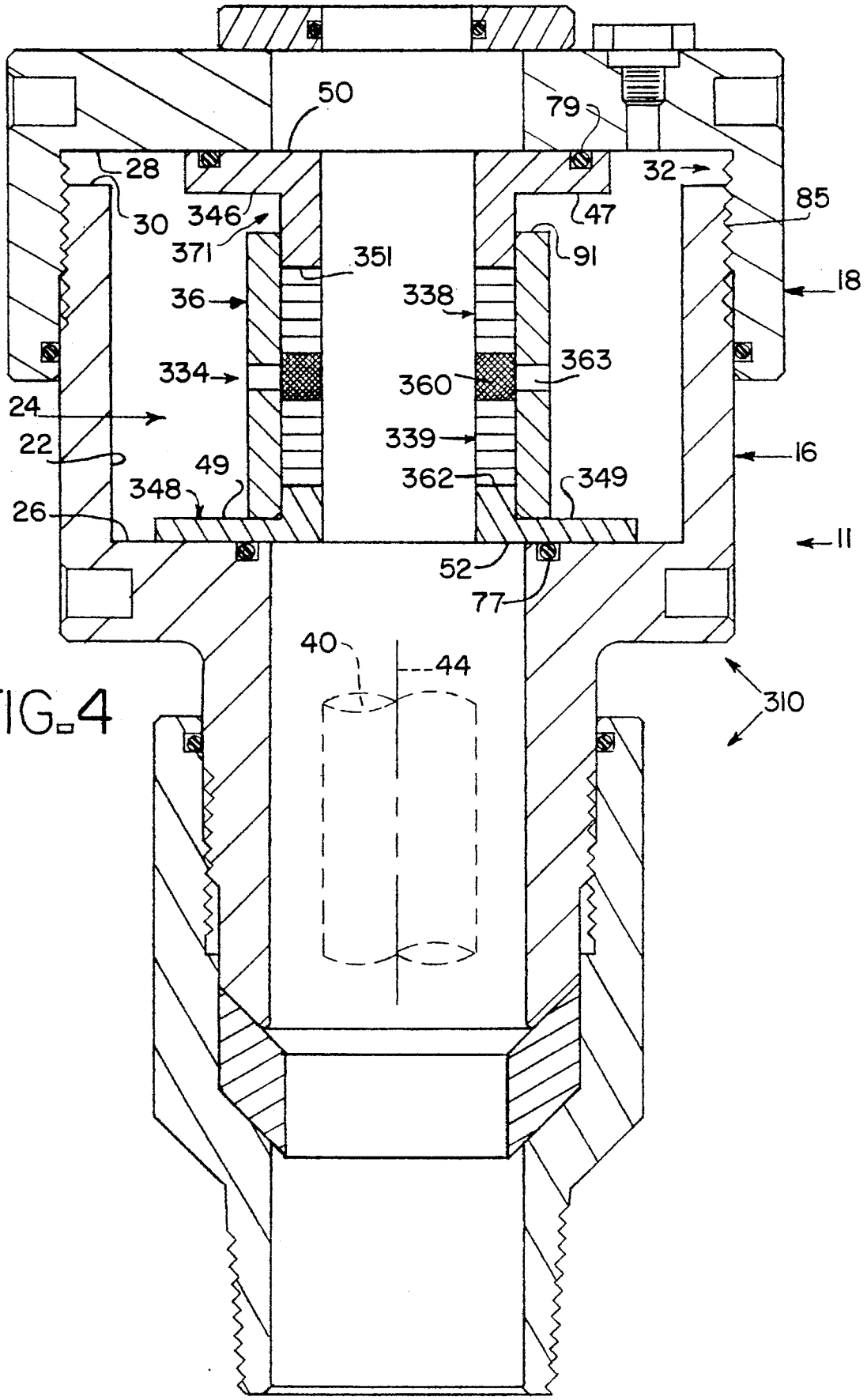
FIG. 4 is a longitudinal, cross-sectional, side view disclosing the fourth embodiment of a stuffing box of this invention.

In FIG. 4, the seal assembly 334 is comprised of a minimum of parts, noting that the upper and lower fixtures 346 and 348 cooperate with the spacer 36 and lube bushing 360 to form a single seal receiving variable cavity within which spaced compression type seal packs 338, 339 are suitably received in spaced relationship respective to one another. The opposed upper and lower fixtures 346 and 348 directly contact the roof and floor with o-ring seals 77, 79 providing a seal as the fixtures are urged thereagainst by the two compression type seal packs 338, 339. Member 360 preferably is a formed annular member made of compressed porous sponge metal that receives lubricant flowing from lube port 363, and meters lubricant from the lube chamber 24 onto the upper and lower compression type seal packs.

In FIG. 4, the upper fixture 346 of seal assembly 334 is reciprocatingly received within the upper inner marginal end of spacer 36 and thereby forms a seal receiving variable cavity within which spaced compression type seal packs 338 are suitably received. Note that no o-ring seal is necessary between the two reciprocating surfaces formed between members 36, 346, and 348 because the compression type seal packs eliminate the need therefor. The opposed upper and lower fixtures 346 and 348 may be forced towards one another by adjusting the closure means 18 downwardly whereupon the roof and floor are urged towards on another which results in compression of the seals contained within seal packs 338, 339. An unexpected result that is realized in arranging the individual seal elements in the manner of FIG. 4 lies in achieving a compression gradient across the dual seal pack wherein a greater compression force is effected on the uppermost packing element, with each succeeding packing element being compressed less than the next lower adjacent packing thereof, with the lowest seals of the lower seal pack being the least compressed. Accordingly, the applied force on the seal apparatus can be adjusted whereby there always are seals present that are compressed between the two extremes of too little compression and the optimum compression, for example.

Figure 5:
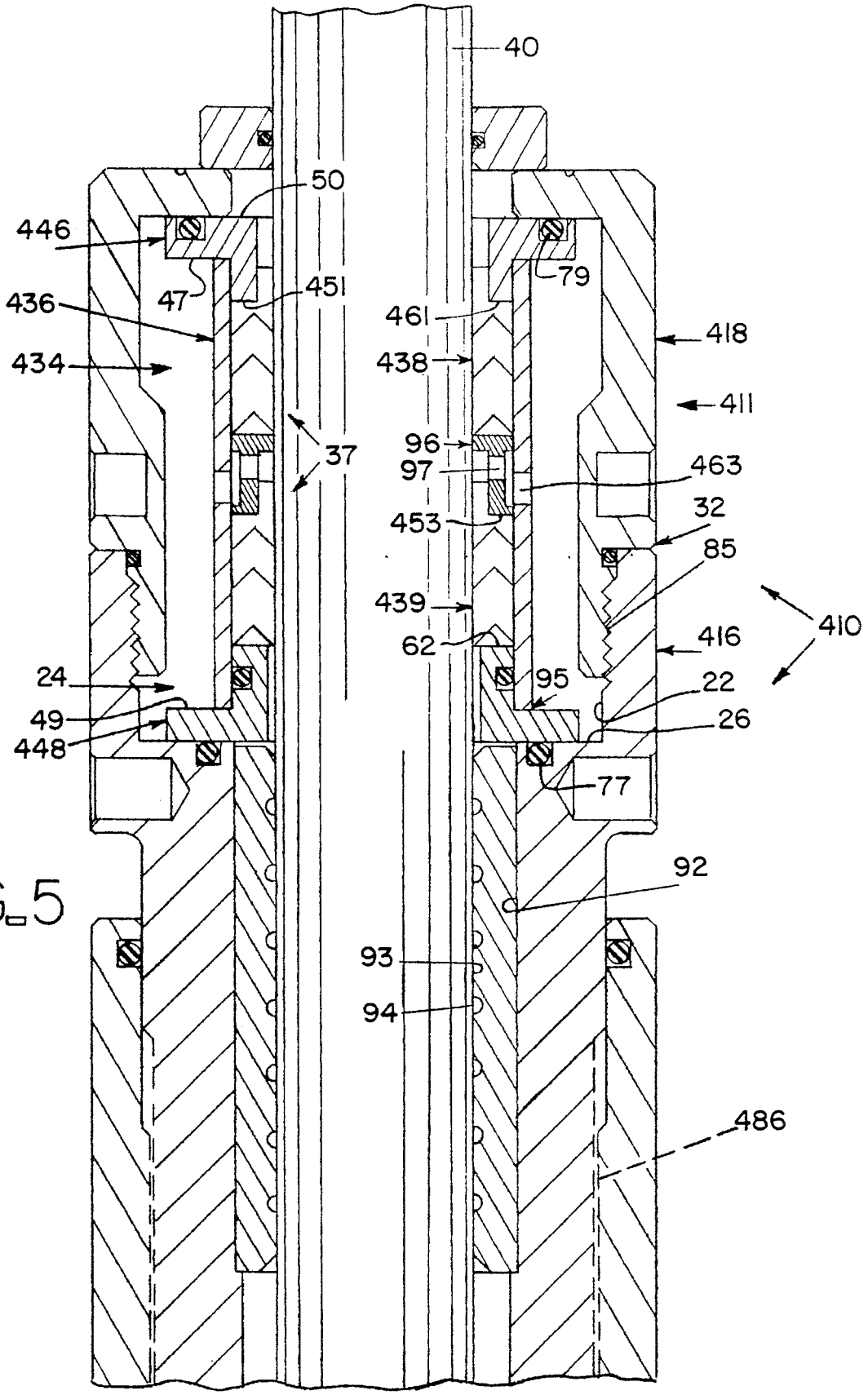
FIG. 5 is a longitudinal, cross-sectional, side view of a fifth embodiment of a stuffing box of this invention; and, FIG. 6 is a longitudinal, cross-sectional, side view illustrating the sixth embodiment of a stuffing box of this invention.

In FIG. 5, the seal assembly 434 is comprised of a pair of upper and lower fixtures 446 and 448, respectively, arranged in fixed relationship respective to the annular spacer 436 and, the opposed ends 62 and 451 of the upper and lower fixtures, respectively, to form suitable seal receiving constant depth cavities within which a pair of spaced hydraulic type seal packs 37 are suitably received. The opposed faces of the upper and lower fixtures 446 and 448, respectively, are arranged to directly contact the roof and floor o-ring seals 77, 79, respectively, as they are urged thereagainst by the centrally located annular sleeve 436 when the closure means 418 is properly spaced out and the threads 85 thereof properly torqued. The lube bushing 96 is of annular configuration and has opposed centrally located concentric faces formed thereon for receiving the confronting faces of the pair of seal packs 338 and 339 seated thereon. The lube bushing 96 is apertured to form a plurality of radial lube ports 97 which form a suitable flow path for lubricant to flow from lube chamber 24 onto the pair of seal packs 37 of the seal assembly 434, thereby providing lubricant at the interface formed between the polished rod 40 and the illustrated hydraulically set seal packs 438 and 439.

An elongated, longitudinally disposed, axially aligned, annular Canterbury 92 is formed in the lower part of the main body 411 and receives an annular bushing 93 axially therewithin, thereby axially aligning all of the components of the main body 411 as well as the polished rod therewith. A plurality of circumferientially extending grooves 94 are formed on the inside wall of the bushing 93 to accumulate any excess lube oil transferred from the seal assembly, thereby applying additional lubrication onto the polish rod 40.

Figure 6:
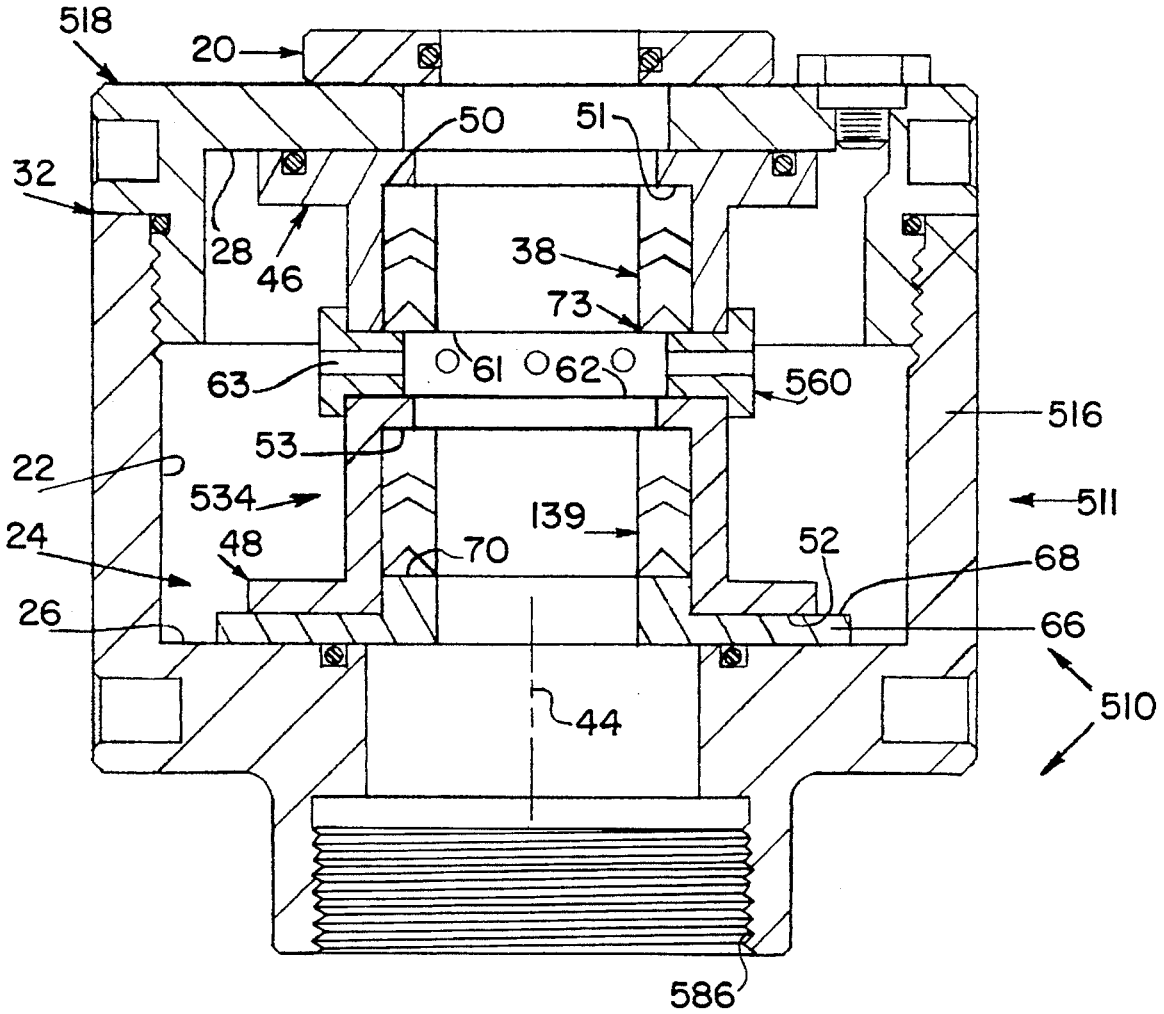

In FIG. 6, the interior of housing 516 is provided with a seal assembly 534 having upper seal pack 38 separated from lower seal pack 139 by the illustrated coacting lube bushing 560. The lube bushing 560 is of annular configuration and has opposed centrally located recesses 61 and 62 formed axially therein for receiving seal packs 38 and 139 seated therein. The lube bushing 560 is apertured to form a plurality of radial lube ports 63 which form a flow path for lubricant to flow from lube chamber 24 onto each of the seal packs thereby providing lubricant at the interface between the polished rod and seal packs.

Annular fixture 46 of FIG. 6 captures or loosely supports the seal pack 38 and has a circumferientially extending shoulder 51 for abuttingly engaging the upper end of seal pack 38 as seen at 51, and thereby loosely captures the seal 38 within the confines afforded by the confronting faces 51, 61, respectively, of the annular fixture 46 and the lube bushing 560. In a similar manner, the lower seal pack 139 is arranged with the opposed ends thereof loosely received between the faces 53, 70 of the lower fixture 48 when a pressure set seal pack 139 is employed.

In the figures of the drawings, and in particularly FIGS. 2, 5 and 6, wherein both the upper and lower seal packs 38 and 139 comprise pressure set seals, those skilled in the art will appreciate that as the rod 40 is reciprocated within the stuffing box 110, ambient pressure is effected against the upper face of the uppermost seal means 38 of the pair of seal packs 137, while the wellbore pressure is effected against the lowermost face of the lower seal means 139. The seals within each seal pack are always arranged such that the lips thereon are pointed down and thereby wipe the lube oil from the rod surface on the upstroke, and provide lubrication for the rod on the downstroke. Any residual lube oil remaining at the end of the upstroke provides additional lubrication during the downstroke. This action results in long seal life, but it can also often require an excessive amount of lubricant, as will be more fully appreciated later on herein.

The bottom seal pack is usually the first to fail, whereupon produced oil becomes free to communicate with the upper seal pack as well as with the lube chamber. This results in accelerated wear and shortened life of the upper seal pack, which up until now had a long life expectancy due to the protection of the operative lower seal pack. Consequently, where the lower seal pack is of the compression type, and has commenced to malfunction due to wear, it is desirable to be able to adjust the lower seal pack without adjusting the upper pressure set seal pack, which is captured in an optimumly adjusted manner and is best left alone.

Therefore, it is advantageous to use a pressure set type seal pack for the upper seal means and an adjustable compression type seal pack for the lower seal means only if means are available to enable adjustment of the lower seal means.

In the various different embodiments of this invention, when a pressure set lower seal pack is employed, lube oil skids or hydroplanes under the lip of the seal and thereby is pumped from the lube chamber into the annulus and where it is admixed with the production fluid. This results in the lube oil being rapidly depleted which results in early failure of the lower seal pack. Further, where only half the lube oil in the lube oil chamber is available for use (see FIGS. 4–6), failure is more likely to occur sooner due to the depletion being undetected in time to save the seal integrity. In any event, this described seal structure is beneficial but perhaps not always as desirable as compared to the described seal structure or assembly of FIGS. 1, 2 and 3.

On the other hand, many unforeseen advantages are realized when a pressure set upper seal pack is employed in conjunction with a compression set lower seal pack made in accordance with the present invention. In this instance the lube oil will not skid or hydroplane across the sealed interface between the rod or shaft and the seal, because the oil is wiped from the rod surface by the compressive force of the seal on both the upstroke and downstroke, and as long as the proper compressive forces are effected across the seal faces of the lower seal pack, the lube chamber will be slowly rather than rapidly depleted, the lower seal will enjoy an unusually long life, and the upper seal pack will always be available when the lower seal pack does finally fail.

The embodiment of FIGS. 4, 5 and 6 often will be employed in conjunction with a pump or motor having a rotatable shaft which does not displace the oil in the above described manner. Moreover, arranging the longitudinal axis of the shaft horizontally avoids early failure of the lower seal pack due to the availability of the entire lube oil supply contained in the lube oil chamber. In this instance, failure of the seals is not as likely to occur prior to depletion of the entire lube oil supply, so the low level may be detected in time to save the seal integrity. In any event, this described seal structure or assembly of this invention is a great advantage over other seal structures.

In operation, as the apparatus of the invention is assembled, the seal assembly isolates the oil reservoir 24 from ambient, leaving sufficient tolerance between interfaces 50, 28 and 26, 67 for the seal assembly to be moved towards and away from the axial centerline of the borehole as may be required to achieve proper alignment of the co-acting parts, while at the same time seals 77 and 79, respectively, sealingly engage the adjacent roof and floor surfaces 28, and 26, respectively.

Annulus 42 is in communication with the upper end of the production tubing and accordingly there is usually a pressure in excess of atmospheric effected on the lower face of flange 67. This places a positive pressure on the lower seal pack 39 as the member 66 urges the lower seal assembly uphole against stop 53 of the lower fixture in proportion to the pressure drop thereacross. Should the lower seal assembly 39 commence failure, there will be leakage through the damaged seal pack, through lube passageway 55, into the lube oil chamber 24, thereby elevating the pressure within the chamber 24. This elevated pressure can be sensed at fill plug 21 to provide a signal, and the resultant signal is connected to circuitry (see 100 of my copending patent application) which in turn is connected to a controller device to shut off the pumpjack motor.

The oil reservoir 24 is filled by removing the filler plug 21. The seal assembly 34 is easily replaced by first setting the pack-off or packer element 13. This is achieved by screwing the main body 16 respective to the adaptor 12 to cause the shoulders of the adaptor 12 and lower part of main body 16 to move towards one another as the threads at 86 are made up. This action causes the illustrated cones to be moved axially toward one another, thereby compressing the elastomeric material of pack-off 13 between the cones and against the polished rod to seal or pack-off the tubing pressure from annulus 42. Next, the closure member 18 is engaged at wrench detents 82, 83 with a suitable wrench and unthreaded at 85 whereupon the closure member can be lifted free of the main body. The entire seal assembly 34 can be removed from the interior 24 of the main body by sliding it up the polished rod. At this time, lubricant from the oil reservoir will gravitate into the annular area located above the pack-off.

Next the seal assembly 34 is parted to expose the upper fixture 46, so that upper seal pack 38 can be replaced after removing the old split seals therefrom. Then the spacer 36 is parted from the lower fixture 48, thereby exposing the wicks which are replaced. Then the lower split seals 39 are removed from the lower seal receiving cavity and a new seal pack is substituted therefor.

It is convenient and sometime necessary to remove the seal assembly 34 from the polished rod in order to replace the o-rings 77, 78, 79 and 82, or to replace the compressed, sponge-like, stainless steel, annular separator or spacer member 360 of FIG. 4 unless it is split. When split, the separator 360 is easily deformed or twisted and removed from the polished rod.

The lower seal pack 39 is placed about the polished rod and within the seal chamber of the lower fixture, which then is moved down into position to be received about the member 71 of the lower support member 66. Next the wicks and the spacer 36 are moved into the illustrated position of FIG. 1, and then the upper fixture and upper seal pack are moved into the illustrated position of FIG. 1, whereupon threads 85 of the closure member can be made up. The oil reservoirs are topped off with clean lubricant after which the main body is rotated back into the configuration of FIG. 2, thereby releasing the pack-off 13 from the polished rod, as its memory returns it to normal configuration. Now the pumpjack unit resumes operation with a new seal assembly in place.

FIGS. 4, 5 and 6 disclose other embodiments 310, 410, and 510 of the invention made especially for accommodating either of rotating and reciprocating shafts, whereas the embodiments 10, 110, 220, set forth in FIGS. 1, 2 and 3 preferably are for use in conjunction with reciprocating shafts. On the other hand, where deemed desirable, either of the embodiments disclosed in FIGS. 1–6 can advantageously be used in conjunction with either reciprocatory and rotational shaft motion.

The new combination of the novel stuffing box, packer apparatus, and pair of seal packs provides new and unobvious and patentable features that reduce the cost of producing an oil well with a pump jack unit.

I claim:

1. A self aligning stuffing box for a pumpjack unit of the type adapted to reciprocatingly receive a polished rod extending therethrough and downhole into a borehole; said stuffing box, comprising:

a main body having an upper end opposed to a lower end, adaptor means at the lower end by which said stuffing box can be mounted respective to a borehole; an upwardly opening chamber formed within said main body and having a chamber floor, a closure member at the upper end of said main body that forms a roof for the chamber;

a longitudinally extending passageway extending through said main body through which a polished rod can extend;

a seal assembly received within said chamber; said seal assembly having inner and outer surfaces and upper and lower faces, with the upper face confronting said roof and the lower face confronting the floor; upper and lower seal means axially aligned and axially spaced from one another and forming at least part of the inner surface of said seal assembly for sealingly engaging a reciprocating polished rod that may extend through the longitudinal passageway;

an oil reservoir formed within the chamber and outwardly of the seal assembly; and means forming a flow path from said oil reservoir to the axially spaced seal means for lubricating said spaced seal means when oil is contained within said oil reservoir;

seal means by which said upper face of said seal assembly sealingly engages said roof of said closure member; and, seal means by which said lower face of said seal assembly sealingly engages the chamber floor of said main body;

whereby, said seal assembly can move laterally of the longitudinal passageway and within the chamber while sealingly engaging the roof and floor and thereby align said seal assembly with a polished rod that may extend through said the passageway of said stuffing box.

2. The stuffing box of claim 1 wherein said seal assembly includes an upper and lower seal mounting fixture mounted therewithin, and said axially spaced seal means includes a seal pack mounted within each said fixture, which form part of the inner surface of said seal assembly.

3. The stuffing box of claim 2 wherein when the seal assembly sealingly engages a reciprocating polished rod, there is a sealed operating condition effected between the upper and lower seal means and the polished rod, and wherein there is included adjusting means associated with said upper and said lower seal means by which only the sealed operating condition of the lower seal means is changed by adjustment of either of said upper and lower seal mounting fixtures; whereby, changes can be effected in the sealed operating condition of said lower seal means but not in the sealed operating condition of said upper seal means without disassembly of the stuffing box.

4. The stuffing box of claim 1 wherein said upper and lower seal means comprises upper and lower spaced annular resilient seal packs having a porous oiling member therebetween, and said flow path connects the porous oiling member and oil reservoir for lubricating the seal assembly and the polished rod.

5. The stuffing box of claim 1 wherein when the seal assembly sealingly engages a reciprocating polished rod, there is a sealed operating condition effected between the upper and lower seal means and the polished rod, and wherein said seal assembly includes an upper seal mounting fixture within which said upper seal means of said seal assembly is captured, and a lower seal mounting fixture within which said lower seal means is compressed;

means by which adjustment of said lower seal mounting fixture changes the sealed operating condition of said lower seal means but does not change the sealed operating condition of said upper seal means.

6. The stuffing box of claim 5 wherein there is an upper seal pack and a lower seal pack, respectively, mounted within said upper and lower fixture, respectively, said upper seal pack is comprised of at least one seal element that is pressure set and said lower seal pack is comprised of at least one seal element that is compression set;

and means associated with said upper and said lower seal means of said seal assembly by which only the sealed operating condition of the lower seal means is changed by adjustment of either of said upper and lower seal mounting fixtures; whereby, changes can be effected in the sealed operating condition of said lower seal means but not in the sealed operating condition of said upper seal means without disassembly of the stuffing box.

7. An improved stuffing box of the type having a shaft received therethrough in a sealed manner therewithin comprising:

said box having a longitudinal passageway extending therethrough through which a shaft can be received for either of rotational and reciprocating movement;

an inner wall surface that defines an upwardly opening chamber within said stuffing box that is spaced radially from the longitudinal passageway; said chamber has an upper end and a chamber floor; a closure member affixed to the upper end of said chamber;

a seal assembly having an outer wall surface that forms an inner wall of a lubrication chamber; said closure member has a lower face that forms a chamber roof; said seal assembly terminates in opposed upper and a lower flanges; chamber seal means by which the upper flange of said seal assembly engages said lower face of said closure member; and chamber seal means by which the lower flange of said seal assembly engages the chamber floor of the box;

an axial passageway extending longitudinally through said seal assembly in parallel relationship respective to the longitudinal passageway of said box; upper and lower axially spaced seal means mounted within the axial passageway of the seal assembly for sealingly engaging a shaft extending through the longitudinal passageway of the box;

said seal assembly is received within said box and forms said lubrication chamber between said seal assembly and the inner wall surface, whereby movement of said seal assembly radially of said chamber aligns the seals of the seal assembly with a shaft extending therethrough.

8. The stuffing box of claim 7 wherein when the seal assembly sealingly engages a shaft there is a sealed operating condition effected between the upper and lower seal means and the shaft and wherein there is further included upper and lower seal mounting fixtures; said upper seal mounting fixture having an upper seal pack that is comprised of at least one seal element that is pressure set, and, said lower seal mounting fixture having a lower seal pack that is comprised of at least one seal element that is compression or pressure set;

and means associated with said upper and said lower seal mounting fixture by which only the sealed operating condition of the lower seal means is changed by adjustment of either of said upper and lower seal mounting fixtures; whereby, changes can be effected in the sealed operating condition of said lower seal means but not in the sealed operating condition of said upper seal means without disassembly of the stuffing box.

9. The apparatus of claim 7 wherein when the seal assembly sealingly engages a shaft there is a sealed operating condition effected between the upper and lower seal means and the shaft, and wherein there is a dynamic lower seal means and a dormant upper seal means, said dynamic seal means is the recited seal located in the lower fixture; said dormant seal engages the shaft at a location above the dynamic seal means;

said seal assembly includes an upper seal mounting fixture within which said upper seal means is captured and a lower seal mounting fixture within which said lower seal means is compressed;

means by which adjustment of said lower seal mounting fixture changes the sealed operating condition of said lower seal means but does not change the sealed operating condition of said upper seal means.

10. The stuffing box of claim 7 wherein when the seal assembly sealingly engages a reciprocating shaft there is a sealed operating condition effected between the upper and lower seal means and the shaft, and wherein said seal assembly comprises upper and lower spaced annular resilient seal members having a porous oiling member mounted for axial movement therebetween, and passageway means connected to the porous oiling member and lubrication reservoir for lubricating the seal assembly and any shaft that may be received therethrough;

said seal assembly includes an upper seal mounting fixture within which said upper seal means is captured and a lower seal mounting fixture within which said lower seal means is compressed;

means by which adjustment of said lower seal mounting fixture changes the sealed operating condition of said lower seal means but does not change the sealed operating condition of said upper seal means.

11. The stuffing box of claim 7 wherein said seal assembly includes an upper seal mounting fixture within which said upper seal means is captured and a lower seal mounting fixture within which said lower seal means is compressed;

each of the upper and lower seal means include upper and lower seal members having a porous lubricating spacer concentrically arranged therebetween, passageway means by which lubrication flows from said lubrication chamber to said spacer to lubricate the seal means and any shaft that may be received therethrough.

12. The stuffing box of claim 7 wherein said lubrication chamber has circuit means including a pressure actuated switch means connected to measure the pressure in said lubrication chamber and for rendering a pumpjack unit to which the box may be connected inoperative upon the pressure measured within the lubrication chamber reaching a predetermined magnitude.

13. The apparatus of claim 7 wherein said seal assembly is arranged for radial movement within the chamber in a manner such that the passageway of the stuffing box can be moved eccentrically in any radial direction within a plane that lays perpendicular to any shaft that may be received therethrough to thereby accommodate misalignment between a pumpjack horsehead and the vertical axis of a borehole;

said seal comprises upper and lower spaced annular resilient seal members having a porous oiling member therebetween, and passageway means connected to the porous oiling member and lubrication chamber for lubricating the seal assembly and the polished rod; and means that senses seal failure and provides a signal in response thereto by which a pumpjack unit can be de-energized thereby eliminating operation of a hot stuffing box so that contamination of the well site is obviated.

14. A stuffing box adapted for use with a pumpjack unit of the type having a polished rod reciprocatingly received through the stuffing box in a sealed manner therewithin; the stuffing box being attached to the upper end of a production tubing string; the improvement comprising:

said stuffing box has an upwardly opening chamber formed therewithin; a longitudinal passageway extending through said stuffing box through which a polished rod can be reciprocatingly received; a closure member for said stuffing box, said closure member forms a chamber roof, a floor in said stuffing box that forms a bottom of the chamber;

a seal assembly of a size to be received for radial movement within the chamber; said seal assembly has a flange at the upper end thereof opposed to a flange at the lower end thereof; said seal assembly has an upper seal receiving fixture opposed to a lower seal receiving fixture; seal means on the upper and lower seal receiving fixtures and seal means on the opposed flanges for sealingly receiving a polished rod therethrough and thereby forming a sealed passageway extending through the seal assembly for reciprocatingly receiving a polished rod;

said seal assembly is received within said chamber with said opposed flanges, respectively, slidably engaging the roof and floor, respectively, of said chamber and in a sealed manner therewith;

said chamber has an interior wall spaced from said seal assembly, a lubrication chamber jointly formed by said seal assembly, said interior wall, said chamber roof and floor within which the seal assembly can move radially of said chamber wall and thereby align the seal assembly with a polished rod of a pumpjack unit.

15. The improvement of claim 14 wherein when the seal assembly sealingly engages a reciprocating polished rod, there is a sealed operating condition effected between the seal means of the upper and lower seal mounting fixtures and the polished rod;

and means associated with said upper and said lower seal mounting fixture by which only the sealed operating condition of the lower seal means is changed by adjustment of either of said upper and lower seal mounting fixtures; whereby, changes can be effected in the sealed operating condition of said lower seal means but not in the sealed operating condition of said upper seal means without disassembly of the stuffing box.

16. The improvement of claim 14 wherein said seal means of said upper fixture is a seal pack which is comprised of at least one seal that is pressure set; said seal means of said lower fixture is a seal pack that is comprised of at least one seal that is compression set;

there is a dynamic seal means and an inactive seal means, said dynamic seal means is the recited lower seal pack and said inactive seal means is at a location above the dynamic seal means;

whereby: said inactive seal means becomes the active seal means when the dynamic seal means becomes worn.

17. The improvement of claim 14 wherein there is a pressure set seal pack spaced from a compression set seal pack, said compression set seal pack is the recited lower seal pack located within the lower seal fixture of the seal assembly; said pressure set seal pack is the upper seal located above the lower seal pack;

whereby: said pressure set seal pack is brought into use upon said compression set seal pack becoming unduly worn.

18. The improvement of claim 14 wherein said seal means of the upper and lower seal receiving fixtures comprises upper and lower spaced annular resilient seal members having a porous annular oiling spacer member received for axial movement therebetween, and passageway means connected to the porous oiling spacer member and lubrication chamber for lubricating the seals of the seal assembly and the polished rod.

19. The improvement of claim 14 wherein, when the seal assembly sealingly engages a reciprocating polished rod, there is a sealed operating condition effected between the upper and lower seal means and the polished rod, and further including an upper seal pack that is comprised of at least one seal element that is pressure set, and a lower seal pack that is comprised of at least one seal element that is compression set;

and means associated with said upper and said lower seal mounting fixtures by which only the sealed operating condition of the lower seal means is changed by adjustment of either of said upper and lower seal mounting fixtures; whereby, changes can be effected in the sealed operating condition of said lower seal means but not in the sealed operating condition of said upper seal means without disassembly of the stuffing box.

20. The improvement of claim 19 wherein said lubrication chamber has a pressure actuated sensor means associated therewith and connected to circuit means for de-energizing the operation of the pumpjack when the pressure in the lubrication chamber reaches a predetermined value.

* * * * *